US005305422A

United States Patent [19]

Junqua

[11] Patent Number: 5,305,422

[45] Date of Patent: Apr. 19, 1994

[54] METHOD FOR DETERMINING BOUNDARIES OF ISOLATED WORDS WITHIN A SPEECH SIGNAL

[75] Inventor: Jean-claude Junqua, Santa Barbara, Calif.

[73] Assignee: Panasonic Technologies, Inc., Santa Barbara, Calif.

[21] Appl. No.: 843,013

[22] Filed: Feb. 28, 1992

[51] Int. Cl.[5] ..... G10L 9/00

[52] U.S. Cl. ..... 395/2.62

[58] Field of Search ..... 381/41–49, 381/29–40; 395/2.62

[56] References Cited

U.S. PATENT DOCUMENTS

| | | | |
|---|---|---|---|
| 4,700,392 | 10/1987 | Kato et al. | 381/46 |
| 4,700,394 | 10/1987 | Selbach et al. | 381/46 |
| 4,821,325 | 4/1989 | Martin et al. | 381/46 |
| 4,829,578 | 5/1989 | Roberts | 381/46 |

*Primary Examiner*—Michael R. Fleming

*Assistant Examiner*—Michelle Doerrler

*Attorney, Agent, or Firm*—Price, Gess & Ubell

[57] ABSTRACT

A method for analyzing a speech signal to isolate speech and nonspeech portions of the speech signal is provided. The method is applied to an input speech signal to determine boundary values locating isolated words or groups of words within the speech signal. First, a comparison signal is generated which is biased to emphasize components of the signal having preselected frequencies. Next, the system compares the comparison signal with a threshold level to determine estimated boundary values demonstrating the beginning and ending points of the words. Once the estimated boundary values are calculated, the system adjusts the boundary values to achieve final boundary values. The specific amount of adjustment varies, depending upon the amount of noise present in the signal. The final pair of boundary values provide a reliable indication of the location and duration of the isolated word or group of words within the speech signal.

15 Claims, 7 Drawing Sheets

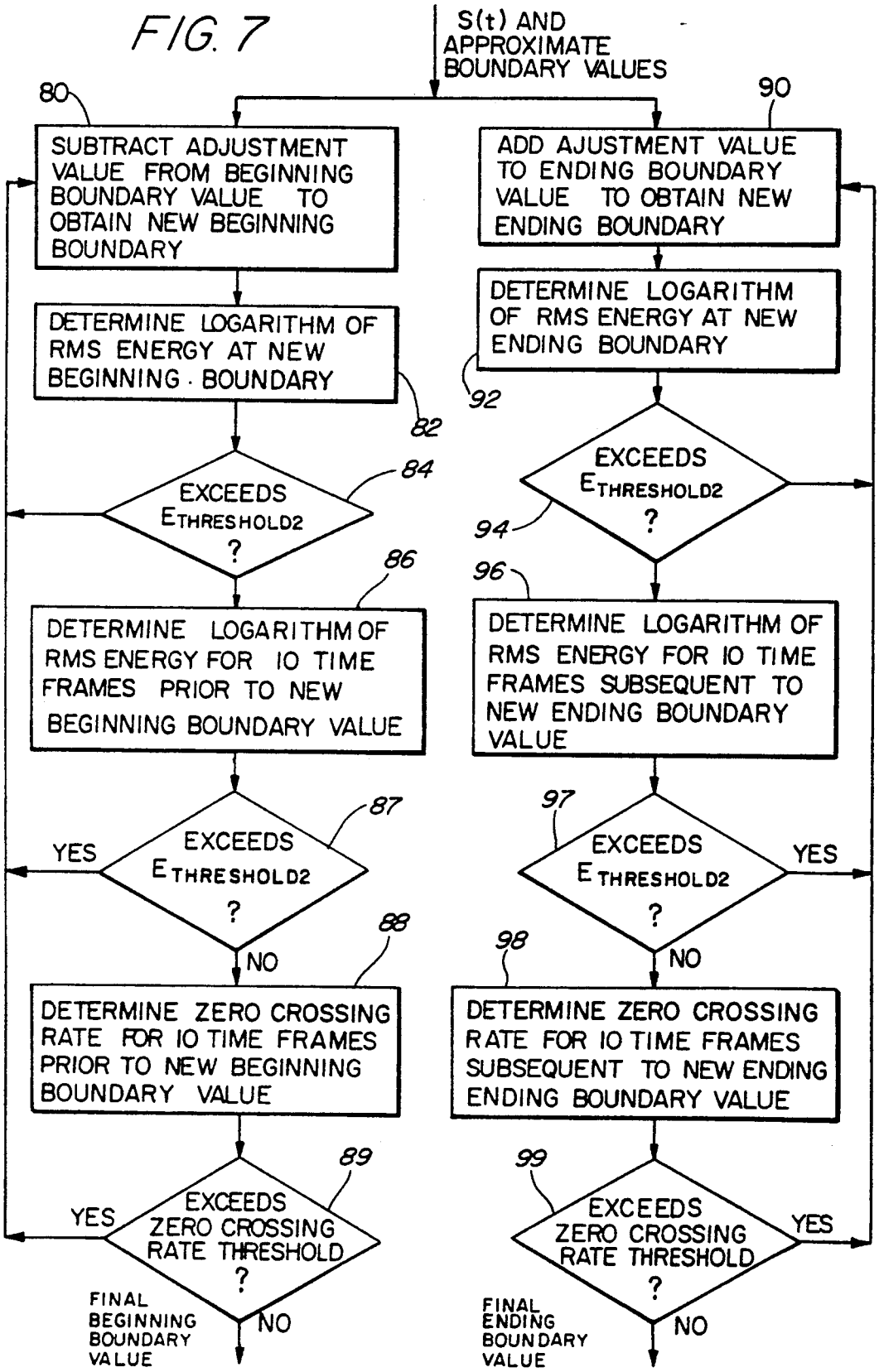
FIG. 7
S(t) AND APPROXIMATE BOUNDARY VALUES
80
SUBTRACT ADJUSTMENT VALUE FROM BEGINNING BOUNDARY VALUE TO OBTAIN NEW BEGINNING BOUNDARY
DETERMINE LOGARITHM OF RMS ENERGY AT NEW BEGINNING BOUNDARY
82
EXCEEDS E THRESHOLD2 ?
84
YES
NO
86
DETERMINE LOGARITHM OF RMS ENERGY FOR 10 TIME FRAMES PRIOR TO NEW BEGINNING BOUNDARY VALUE
EXCEEDS E THRESHOLD2 ?
87
YES
NO
88
DETERMINE ZERO CROSSING RATE FOR 10 TIME FRAMES PRIOR TO NEW BEGINNING BOUNDARY VALUE
EXCEEDS ZERO CROSSING RATE THRESHOLD ?
89
YES
NO
FINAL BEGINNING BOUNDARY VALUE
90
ADD AJUSTMENT VALUE TO ENDING BOUNDARY VALUE TO OBTAIN NEW ENDING BOUNDARY
DETERMINE LOGARITHM OF RMS ENERGY AT NEW ENDING BOUNDARY
92
EXCEEDS E THRESHOLD2 ?
94
96
DETERMINE LOGARITHM OF RMS ENERGY FOR 10 TIME FRAMES SUBSEQUENT TO NEW ENDING BOUNDARY VALUE
EXCEEDS E THRESHOLD2 ?
97
YES
NO
98
DETERMINE ZERO CROSSING RATE FOR 10 TIME FRAMES SUBSEQUENT TO NEW ENDING ENDING BOUNDARY VALUE
EXCEEDS ZERO CROSSING RATE THRESHOLD ?
99
YES
NO
FINAL ENDING BOUNDARY VALUE

METHOD FOR DETERMINING BOUNDARIES OF ISOLATED WORDS WITHIN A SPEECH SIGNAL

BACKGROUND OF THE INVENTION

Field of the Invention

The present invention relates generally to speech recognition systems and, in particular, to a system for determining the location of isolated words within a speech signal.

Description of Related art

A wide variety of speech recognition systems have been developed. Typically, such systems receive a time-varying speech signal representative of spoken words and phrases. The speech recognition system attempts to determine the words and phrases within the speech signal by analyzing components of the speech signal. As a first step, most speech recognition systems must first isolate portions of the speech signal which convey spoken words from portions carrying silence. To this end, the systems attempt to determine the beginning and ending boundaries of a word or group of words within the speech signal. Accurate and reliable determination of the beginning and ending boundaries of words or sentences poses a challenging problem, particularly when the speech signal includes background noise.

A variety of techniques have been developed for analyzing a time-varying speech signal to determine the location of an isolated word or group of words within the signal. Typically, the intensity of the speech signal is measured. Portions of the speech signal having an intensity greater than a minimum threshold are designated as being "speech," whereas those portions of the speech signal having an intensity below the threshold are designated as being silent portions or "nonspeech." Unfortunately, such simple discrimination techniques have been unreliable, particularly where substantial noise is present in the signal. Indeed, it has been estimated that more than half of the errors occurring in a typical speech recognition system are the result of an inaccurate determination of the location of the words within the speech signal. To minimize such errors, the technique for locating isolated words within the speech signal must be capable of reliably and accurately locating the boundaries of the words, despite a high noise level. Further, the technique must be sufficiently simple and quick to allow for real time processing of the speech signal. Furthermore, the technique must be capable of adapting to a variety of noise environments without any a priori knowledge of the noise. The ability to accurately and reliably locate the boundaries of isolated words in any of a variety of noise environments is generally referred to as the robustness of the technique. Heretofore, a robust technique for accurately locating words within a speech signal has not been developed.

OBJECTS AND SUMMARY OF THE INVENTION

In view of the foregoing, it can be appreciated that there is a need to develop an improved technique for locating isolated words or groups of words within a speech signal in any of a variety of noise environments.

Accordingly, it is an object of the invention to provide such an improved technique for locating isolated words or groups of words within a speech signal; and It is a further object of the invention to provide such a technique in a sufficiently simple form to allow for real time processing of a speech signal.

These and other objects of the invention are achieved by a speech-detecting method wherein a comparison function representative, in part, of portions of a speech signal having frequencies within a preselected bandwidth are compared with a threshold value for determining the beginning and ending approximate boundaries of an isolated word or group of words within the speech signal.

In accordance with the preferred embodiment, the method comprises the steps of determining a constant threshold value representative of the level of the signal within regions of relative silence, determining a time-varying comparison signal representative, in part, of components of the speech signal having frequencies within a preselected frequency range, and comparing the comparison signal with the threshold value to determine crossover times when the comparison signal rises above the threshold or decreases below the threshold. A crossover time where the comparison signal rises from below the threshold to above the threshold is an indication of an approximate beginning boundary for a word. A crossover time wherein the comparison signal decreases from above the threshold to below the threshold is an indication of the ending boundary of a word. By determining the first beginning and last ending boundaries of an isolated word or group of words within the signal, the location of the isolated word or group of words within the signal is thereby determined.

The threshold value is calculated from the maximum value, $E_{max}$, of the root-mean-squared (RMS) energy contained within the speech signal, and determining an average value, $E_{ave}$, for the RMS energy of the speech signal within the regions of relative silence. The threshold is given by the equation:

$$E_{threshold}=((E_{max}-E_{ave})*E_{ave}^3)*A,$$

where A is a preselected constant.

The comparison signal is generated by, first, dividing the speech signal into a set of individual time-varying signals, with each time-varying signal including only a portion of the overall speech signal. Next, the individual time-varying signals are separately processed to calculate a comparison value emphasizing frequencies of the individual signals within the preselected frequency range. To this end, each individual time-varying signal is converted to a frequency-varying signal by a Fourier transform. Once converted to a frequency-varying signal, the components of the individual signal having frequencies within the preselected frequency range are easily summed or integrated to yield a single intermediate comparison value. Since each individual signal of each time frame is processed separately, a plurality of intermediate comparison values are calculated, with the various intermediate comparison values together comprising the intermediate comparison signal. Preferably, the preselected frequency range includes frequencies between 250 and 3,500 Hz.

Also, for each time frame, the logarithm of the RMS energy of the individual signal within the time frame is computed and added to the intermediate comparison value to yield a final comparison function.

Once calculated, the comparison function is compared with the threshold value to determine whether it exceeds the threshold value. In this manner, crossover times, wherein the comparison signal crosses to above or below the threshold value, are determined. The first and last crossover times provide a first approximation for the beginning and ending boundaries of the isolated word or group of words within the speech signal.

The first approximation of the boundary end points are further processed to provide a more accurate, refined determination of the end points. To this end, the noise level of the speech signal is evaluated. If the evaluation reveals that the speech signal is noisy, typically less than or equal to 15 dB, then an adjustment value is calculated for use in adjusting the end points. The adjustment value is calculated from the equation:

$$\text{adjustment} = B^{*}E_{ave} + C,$$

wherein B and C are preselected constants.

The values of B and C are determined by the amount of noise present in the speech signal. The adjustment value is subtracted from the beginning boundary values to provide a final approximation of the beginning boundary values. Likewise, the adjustment value is added to the ending boundary values to yield a final approximation of the ending boundary value.

If the evaluation of the noise level indicates that the signal is not noisy, then an iterative adjustment technique is performed. First, a preselected value, such as 20 msec, is subtracted from the approximate beginning boundary value, and a second preselected value, such as 50 msec, is added to the approximate ending boundary value. Next, a second threshold value, $E_{threshold2}$, is calculated from the equation:

$$E_{threshold2} = (E_{max} - E_{ave})/D + E_{ave}.$$

The logarithm of the RMS energy of the speech signal of the second approximated end points is compared with the second threshold value. If the logarithm of the RMS energy is greater than the second threshold, the steps of adding and subtracting the preselected adjustment values to the end points are again performed, thus yielding an updated approximation for the end points. Then, the logarithm of the RMS energy in the neighboring region of the new end points is checked against the second threshold value. This iterative process continues until the end points have been adjusted a sufficient amount to be reliably below the second threshold value. This iterative technique operates to reliably locate the boundaries of the words when the noise level is low.

The just-described iterative technique involving the calculation of the logarithm of the RMS energy may be supplemented with a similar calculation of the zero crossing rate of the speech signal such that the adjustment of the boundary values depends both on the RMS energy in the vicinity of the end points and the zero crossing rate in the vicinity of the end points.

In this manner, regardless of whether a high or low noise level exists within the speech signal, the boundary values of an isolated word or group of words within the speech signal are reliably located. Once the boundary values have been reliably determined, the location of the isolated word or group of words is therefore reliably determined. Processing of the words may then proceed to determine the content of the words or the sentence.

By generating a comparison signal emphasizing mid-range frequencies, the location of the words is more reliably determined, despite a high noise level. By adjusting the boundary end points of the words in the manner described above, a more accurate and refined determination of the word boundaries is achieved. The frequency band of 250–3,500 Hz is preferably employed because desired components of speech occur within this frequency band. More specifically, the vowel portion of speech of a spoken word primarily occurs within this frequency range. To properly account for varying noise levels, the threshold against which the comparison signal is compared is adjusted according to the level of noise as measured in relatively silent portions of the speech signal. To further adapt to a variety of noise levels, the procedure whereby the beginning and ending boundaries of the words are adjusted likewise adapts to the ambient noise level.

BRIEF DESCRIPTION OF THE DRAWINGS

The features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 7 is a flow chart showing an iterative method whereby the initial estimates of the beginning and ending boundaries of words within the speech signal are adjusted when the noise level of the signal is low.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a method for reliably determining the beginning and ending boundaries of words within a speech signal in the presence of a wide variety of ambient noise levels.

Figure 1:
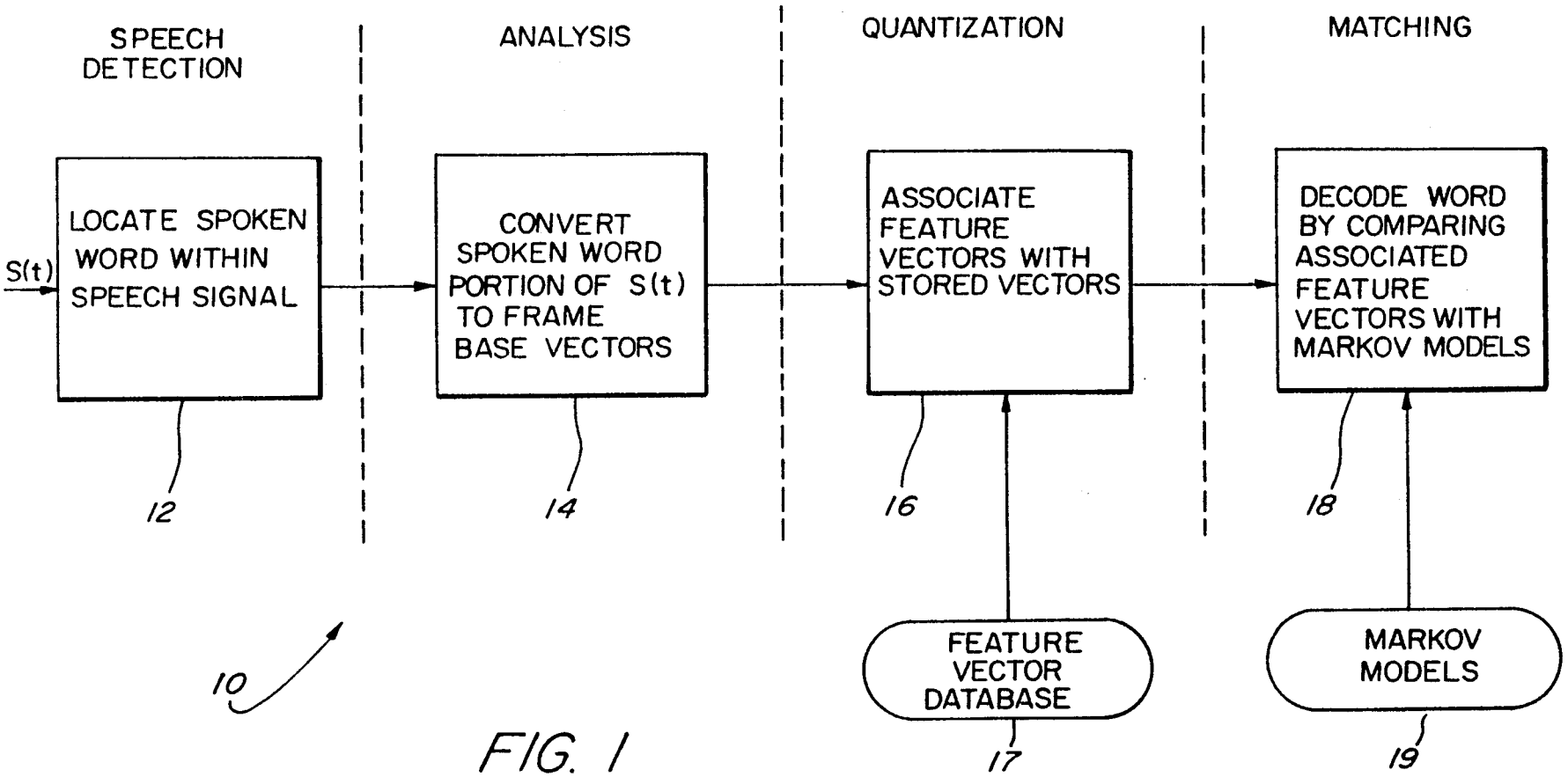
FIG. 1 is a block diagram of a speech recognition method incorporating a preferred embodiment of the present invention.

FIG. 1 provides an overview of a speech recognition system or method incorporating the present invention. The speech recognition system 10 includes a speech detection portion 12 which operates on an input time-varying speech signal S(t) to determine the location and duration of an isolated word or group of words carried within the speech signal. The speech detection portion operates to isolate a portion of the signal comprising "speech" from portions of the signal comprising relative silence or "nonspeech." Thus, if the speech signal includes a single word, the speech detector determines the beginning and ending boundaries of the word. If the speech signal includes a group of words, such as a complete sentence, the speech detector determines the beginning and ending boundaries of the entire sentence. Herein, a reference to the words of a speech signal is a reference to either a single isolated word or a group of words.

Once the location of spoken words within the signal S(t) is determined, the system converts the portion of the signal containing the located words to a set of frame-based feature vectors during an analysis phase 14. Such may be achieved by using a conventional perceptually-based linear prediction technique.

During a quantization phase 16, the system operates to associate the feature vectors with prerecorded vectors stored in a feature vector data base 17. During quantization phase 16, a root power sums weighting technique may be applied to the feature vectors to emphasize a portion of the speech spectrum. Quantization phase 16 may be implemented in accordance with conventional feature vector quantization techniques. Finally, during a matching phase 18, the system operates to compare the associated feature vectors to Markov models 19 to decode the words. The Markov models may be initially generated and stored during a training phase wherein speech signals containing known words are processed.

Analysis phase 14, quantization phase 16, and matching phase 18 are postprocessing steps which will not be described further. The details of speech detection phase 12, wherein the location and duration of words within speech signal S(t) is determined, will now be described within reference to the remaining figures.

Figure 2:
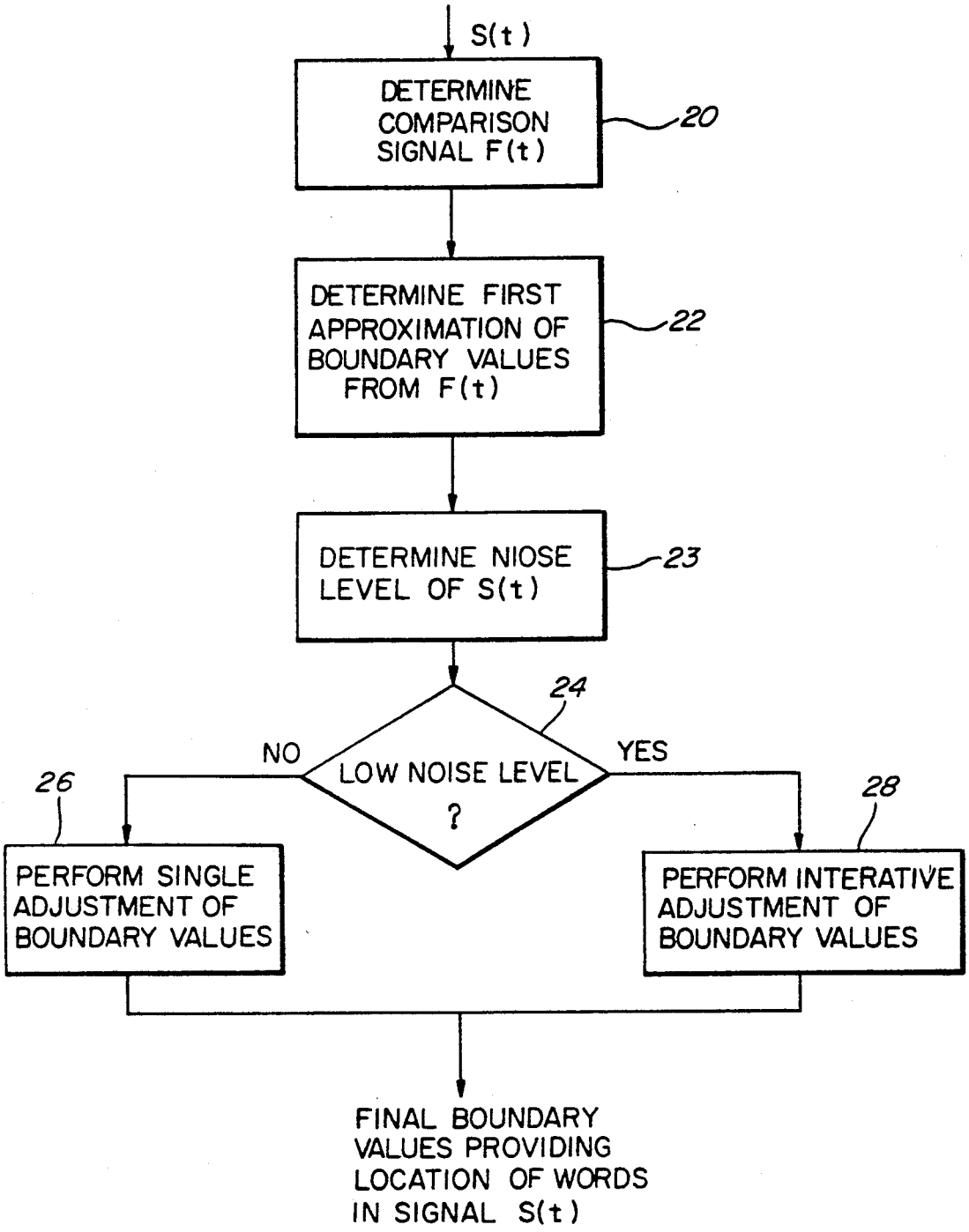
FIG. 2 is a flow chart summarizing a method by which the boundaries of an isolated word or group of words within a speech signal are determined.

An overview of the speech detection phase 12 is provided in FIG. 2. Initially, at 20, the system operates on an input time-varying speech signal S(t) to compute a time-varying comparison signal F(t). As will be described in greater detail, comparison signal F(t) is representative of the logarithm of the RMS energy of the signal biased to emphasize portions of the speech signal having frequencies in a selected frequency range.

Next, at 22, the system calculates a threshold value $E_{threshold}$ for comparison with comparison signal F(t) to determine the beginning and ending approximate boundaries of words within speech signal S(t). The boundary values are time values which indicate the approximate beginning of a spoken word or the approximate end of a spoken word within the time-varying input signal S(t). Thus, the words within speech signal S(t) have an associated beginning boundary value and an ending boundary value. Collectively, the boundary values are also herein referred to as "end points," regardless of whether they designate the beginning or ending boundaries of the words.

Once accurately determined, the end points designate the boundaries between silent portions of the speech signal and a spoken portion of the speech signal. Thus, by determining the boundary values, the spoken words of the signal can be isolated from the silent portions of the signal for further processing in accordance with the steps outlined in FIG. 1. Further, the duration of the words within the speech signal is easily calculated by subtracting the time value of the beginning boundary value from the time value of the ending boundary value. An accurate measurement of the duration of the words is helpful in decoding the words.

Thus, at step 22, the system determines a pair of boundary end point values. These values represent an initial approximation or estimation of the boundary values of words within the speech signal. Given the initial estimates, the system proceeds to adjust the boundary values in accordance with the level of noise present in the speech signal to determine more accurate boundary values. The noise level of the signal is estimated at step 23.

The noise level may be calculated by estimating an average of the logarithm of the RMS energy of the signal in a portion of the signal known to represent silence. At step 24, the system determines whether the noise level of speech signal S(t) is high or low.

If the noise level is high, the system proceeds to step 26 to perform a single adjustment of the boundary values in accordance with a method described in detail below.

If the noise level is low, the system proceeds to step 28, where the system iteratively refines the boundary values in accordance with a method described below with reference to FIG. 7.

As a result of the execution of either steps 26 or 28, the system possesses a pair of final boundary values representing accurate estimates of the actual boundaries between speech and nonspeech portions of signal S(t).

The method by which the system generates comparison signal F(t) will now be described with reference to FIG. 3.

Input speech signal S(t) is a time-varying signal having sound energy or intensity values as a function of time, such as the electrical signal output from a conventional microphone. Preferably, an analog-to-digital converter (not shown) operates on the input speech signal to convert a continuous analog input signal into a discreet signal comprised of thousands or millions of discreet energy or intensity values. Conversion to digital form allows the speech signal to be processed by a digital computer. However, the method of the invention can alternatively be implemented solely in analog form, with appropriate electrical circuits provided for manipulating and processing analog signals. If converted to a digital format, the signal preferably includes at least 100 discrete values per each 10 msec. Signal S(t) comprises a set of time frames, with each time frame covering 10 msec of the signal.

At step 30, signal S(t) is divided into a set of individual signals $s_n(t)$, each representing a portion or window of the original signal. The windows, which may be defined by a sliding Hamming window function, are separated by 100 msec and each includes 20 msec or two time frames. However, the duration, shape, and spacing of the windows are configurable parameters of the system which may be adjusted appropriately to achieve desired results.

Once divided into a set of individual signals defined by separate windows, the system, at 32, separately transforms each individual time-varying signal $s_n(t)$ from the time domain into the frequency domain. Transformation to the frequency domain is achieved by computing the Fourier transform by conventional means such as a fast Fourier transform (FFT) or the like.

Thus, at step 32, the system operates to convert the individual time-varying signals $s_n(t)$ into individual frequency-varying signals $s_n(\nu)$. With each individual time-varying signal covering a time frame of 20 msec padded with zeros to obtain 256 discrete signal values, the resulting frequency domain signal includes 128 discrete values, the FFT producing only one frequency-domain value for every two time domain values. The discrete values of the frequency domain signals will vary from a frequency of approximately 0 upwards to perhaps 5,000 Hz or greater, depending upon the original input signal S(t), the filtering down on the input signal before sampling, and the sampling rate.

At 34, the system operates to smooth the individual frequency domain signals using a conventional smoothing algorithm. Next, at 36, the system determines the total energy or intensity within each individual frequency-varying signal $s_n(t)$ within a preselected frequency bandwidth. Assuming that a frequency bandwidth of 250–3,500 Hz is selected, the system merely integrates or sums all values of $s_n(\nu)$ within the range 250–3,500 Hz, and ignores or discards all values of $s_n(\nu)$ having frequencies outside this range. As can be appreciated, the conversion of the time-varying signals into frequency-varying signals using the fast Fourier transform greatly facilitates the calculation of the total energy or intensity within the preselected frequency range.

For each individual frequency-varying signal $s_n(\nu)$, the system, at step 36, thus calculates a single intermediate comparison value $f_n$. For example, the first individual frequency-varying signal $s_1(\nu)$, corresponding to the first window of input signal S(t), yields a single comparison value of $f_1$. In general, the system computes a single comparison value $f_n(t)$ corresponding to each window of input signal S(t). The various individual comparison values $f_n$, when taken together, comprise a first comparison function f(t) having discreet values arranged as a function of time.

At 38, the system normalizes first comparison function f(t). While the system operates to calculate first comparison function f(t), the system simultaneously computes a second comparison signal g(t) by executing steps 40 and 42. As shown in FIG. 3, steps 40 and 42 can be executed simultaneously with steps 32–38. This may be achieved by utilizing a parallel processing architecture. Alternatively, steps 40 and 42 can be executed subsequent to steps 32–38.

Regardless of the specific implementation, at step 40, the system operates to calculate the logarithm of the RMS energy or intensity of each individual time-varying signal $s_n(t)$. Calculation of the logarithm of the RMS energy or intensity is achieved by conventional means such as by squaring each value within each time-varying signal, summing or integrating all such values within each signal and, finally, averaging and taking the square root of the result.

Thus, step 40 operates to calculate a set of values, each value representing the logarithm of the RMS energy for a single window of input signal S(t). Thus, a set of discreet values $g_n$ are calculated with each value associated with a separate window centered on a separate time value. Taken together, all such values $g_n$ form a second comparison function g(t). At step 42, the system operates to normalize comparison function g(t).

At 44, the system sums comparison signals f(t) and g(t) to produce a single comparison function F(t). At 46, the system smooths comparison function F(t) by a conventional smoothing algorithm. At 48, the system normalizes the smoothed comparison function F(t).

Figure 3:
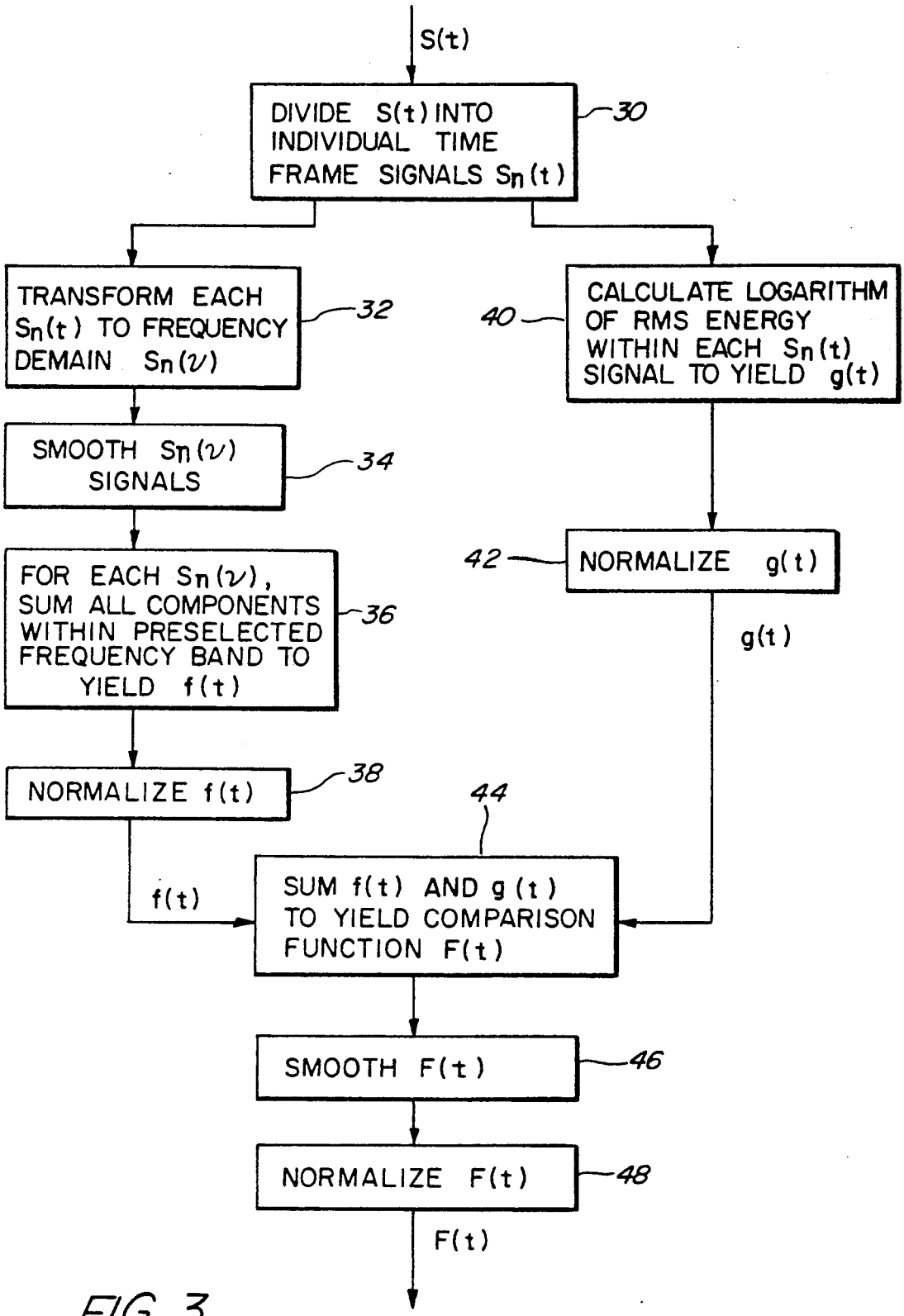
FIG. 3 is a flow chart showing a method by which a comparison signal is generated for use in determining the boundary values of the isolated word or group of words within the speech signal.

The just-described steps shown in FIG. 3 thus operate to process input signal S(t) to generate a comparison function F(t) representative of the logarithm of the RMS energy of the signal biased by components of the signal having frequencies within the preselected frequency range. With regard to step 30, it is not necessary for all individual signals to be calculated prior to processing of steps 32 and 40. In practice, the individual signals are generated sequentially, with each successive signal processed to yield values of $f_n$ and $g_n$ prior to sliding the Hamming window to yield a new individual signal.

Figure 5:
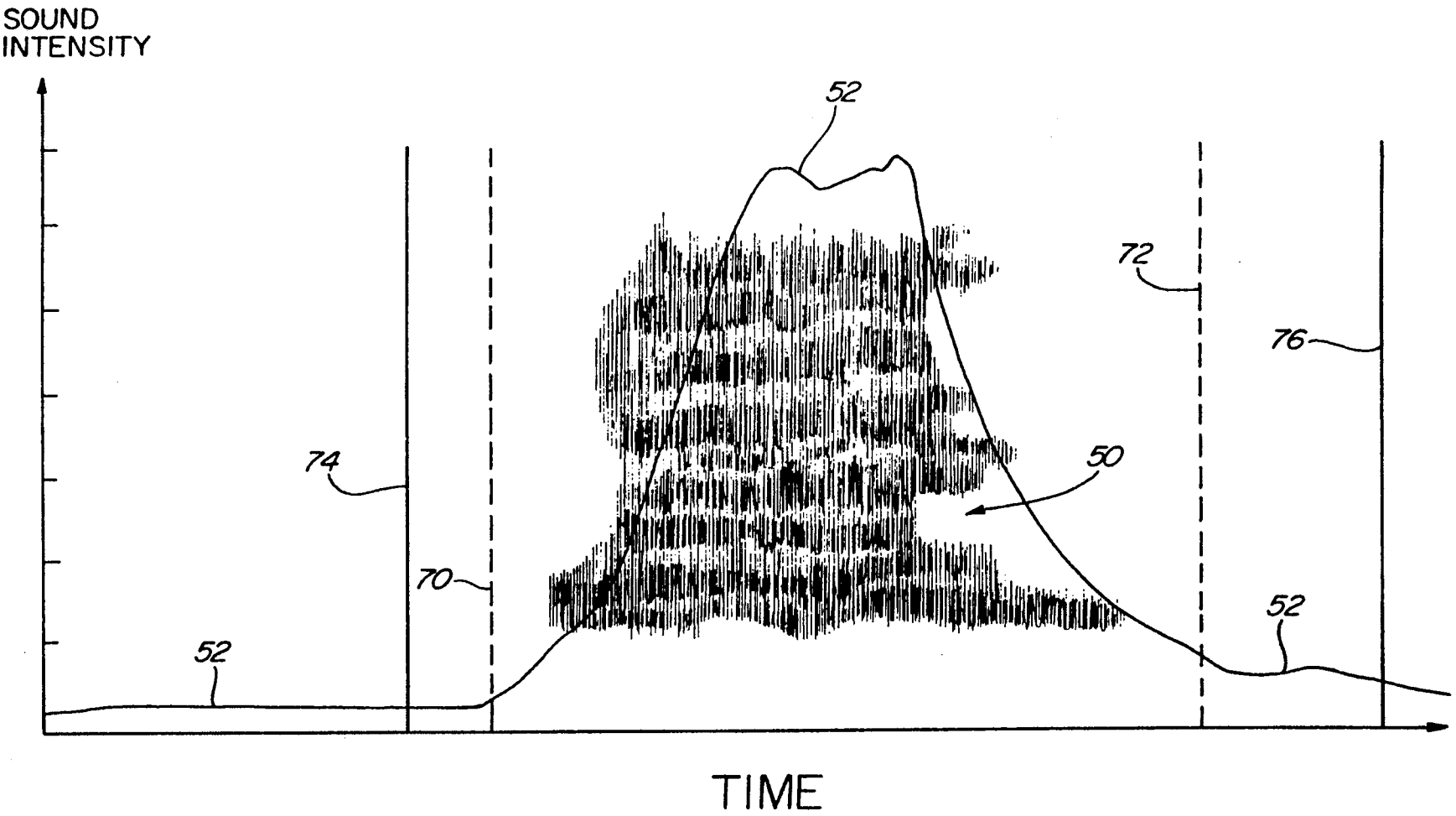
FIG. 5 is a graphic representation of a spectrogram of a speech signal corresponding to the spoken word "one" and showing the comparison signal, as well as initial and final estimates of the beginning and ending boundaries of the word "one[.
Figure 6:
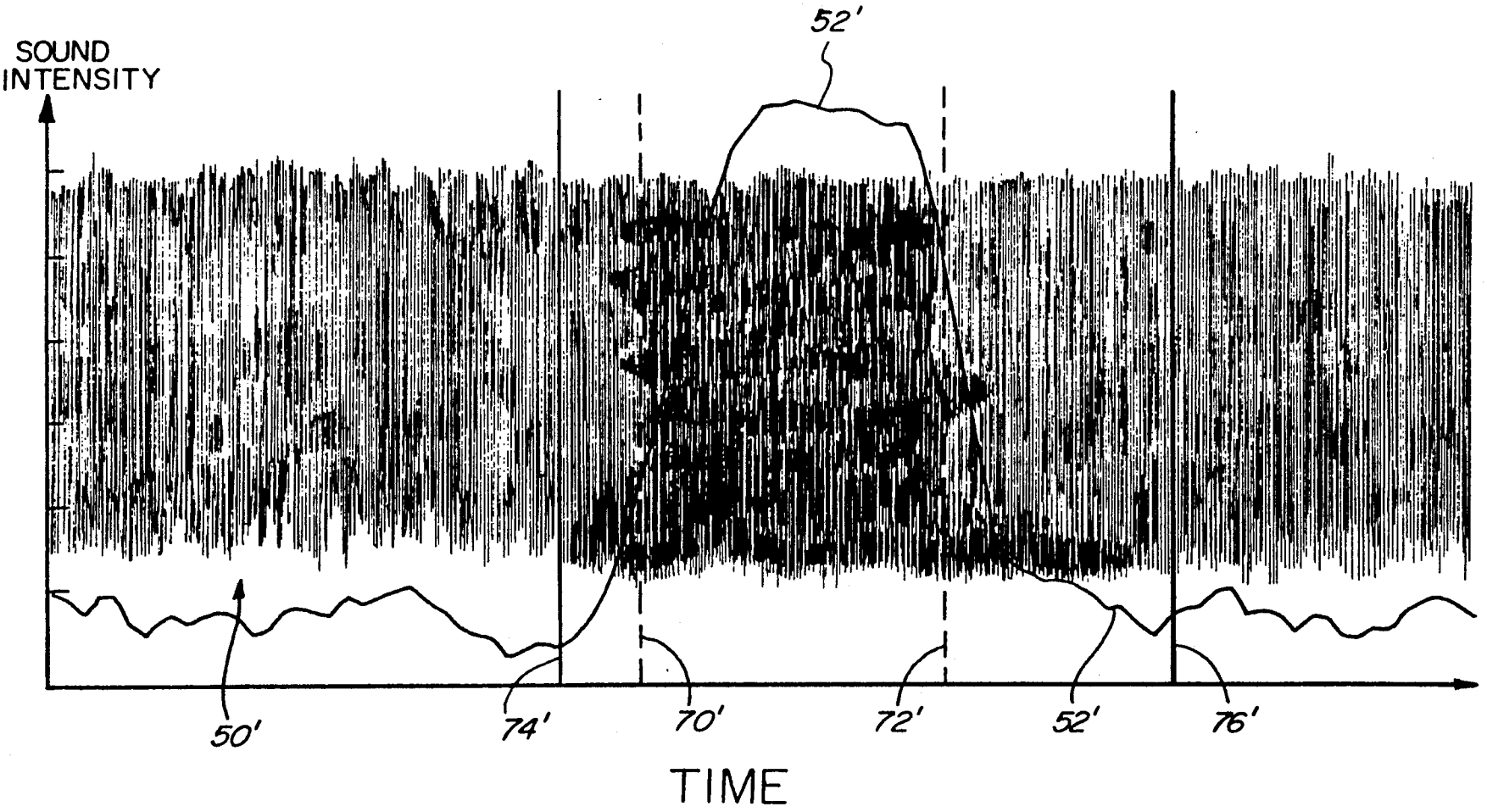
FIG. 6 is a graphic representation of a spectrogram of a speech signal incorporating the spoken word "one," showing the comparison signal, and showing initial and final estimates of the beginning and ending boundaries of the word "one," with the speech signal having a white-Guassian noise with an SNR of approximately 15 dB.

Exemplary comparison signals F(t) are shown in FIGS. 5 and 6. In FIGS. 5 and 6, an input signal S(t) is designated by reference numerals 50 and 50', respectively. The corresponding comparison signal F(t) is represented by reference numerals 52 and 52', respectively. In FIG. 5, input signal S(t) represents a spectrogram of the word "one." In FIG. 6, input signal S(t) also represents the word "one." However, in FIG. 6, input signal S(t) further includes white-Gaussian noise producing an SNR of approximately 15 dB. As can be seen from FIG. 5, the comparison signal corresponds roughly to an outline of the input signal conveying the word "one." Thus, during an initial silent portion of signal S(t), the comparison signal is at a minimum. Likewise, during an ending silent portion of signal S(t), the comparison signal is also at a minimum. Also, as can be seen from FIG. 5, the comparison signal does not perfectly match the boundaries of the spoken word. Rather, the comparison signal primarily represents that portion of the spoken word contained between the first and last vowels of the spoken word. To obtain a more reliable determination of the boundaries of the word, a refinement or adjustment feature, discussed in detail below, is performed.

In FIG. 6, it can be seen that a comparison signal also generally matches the spoken word "one," despite the presence of considerable signal noise. Note, however, that the comparison signal is not as flat in the "silent" portions of the signal as that of FIG. 5. This is the result of the added white-Gaussian noise. As will be described below, a separate refinement or adjustment procedure is performed to compensate for signals having a high noise level, such as that of FIG. 6.

Figure 4:
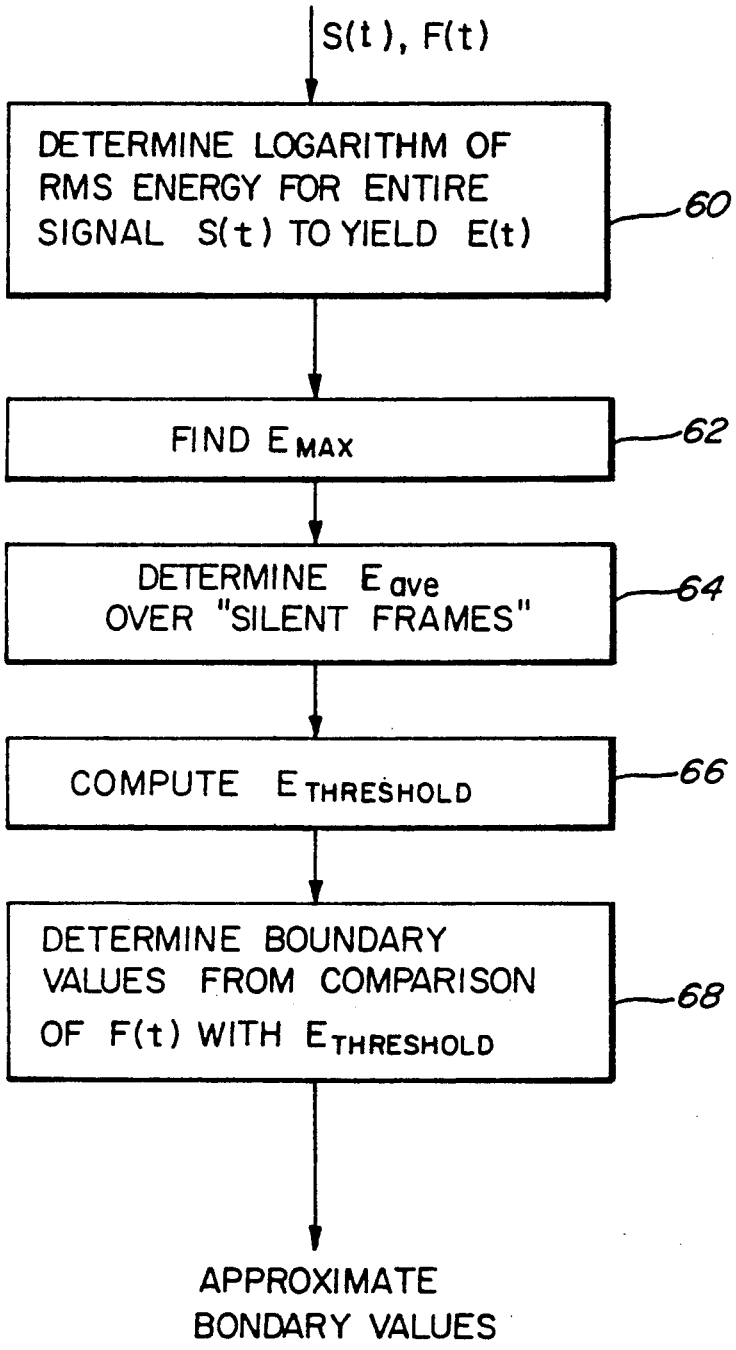
FIG. 4 is a flow chart showing a method by which the comparison signal is compared with a threshold value to determine an initial estimate or approximation of the beginning and ending boundaries of words within the speech signal.

Referring to FIG. 4, the method by which the system analyzes the comparison function F(t) to determine initial and ending boundary values for words contained within the input speech signal is described.

At 60, the system computes the logarithm of the RMS energy for the entire input speech signal S(t) to produce a function E(t) varying in time. Computation of E(t) may be facilitated by retrieving the individually-calculated RMS energy functions calculated for each time window at step 40, shown in FIG. 3. Regardless of the specific method of computation, the result of step 60 is a time-varying function, E(t), covering the entire time span of the input signal S(t).

At 62, the system determines the maximum value of E(t). This value is designated $E_{max}$. At 64, the system determines the average of E(t) over "silent" portions of the input signal Preferably, $E_{ave}$ is an average over 10 frames of the input signals that are known to be "silent;" i.e., these frames do not include any spoken words, although they may include considerable noise. A simple method for producing "silent" frames for use in calculating $E_{ave}$ is to record at least 10 silent frames prior to recording an input signal.

Once $E_{max}$ and $E_{ave}$ are calculated, the system proceeds, at step 66, to compute a threshold level $E_{threshold}$ from the equation:

$$E_{threshold}=((E_{max}-E_{ave})*E^3_{ave})*A \quad (1)$$

Parameter A represents a constant which is a configurable parameter of the system, preferably determined by performing experiments on known input signals to determine an optimal value. A value of 2.9 has been found to be effective for use as the parameter A.

At 68, the system compares comparison function F(t) with $E_{threshold}$ to determine when the comparison function exceeds the threshold value. The first and last points where the comparison function crosses the threshold value, either by rising from below the threshold to exceed the threshold, or by dropping from above the threshold to below the threshold, represent approximate boundary values for words recorded within the signal. A single pair of approximate boundary values are thereby determined. If only one word is recorded within the signal, such as shown in FIGS. 5 and 6, then the pair of approximate boundary locations of the word. If a group of words are recorded within the input signal, then the pair of approximate boundary values indicate the approximate beginning and ending points of the group of words.

In FIGS. 5 and 6, exemplary approximate boundary values are indicated with dashed vertical lines and identified by reference numerals 70 and 72, with 70 representing a beginning word boundary and 72 representing an ending word boundary.

In certain applications, such as where extremely low noise signals are processed, these approximate boundary values may be sufficiently accurate to identify the locations of the words for subsequent processing of the individual words. However, in many cases, an adjustment or refinement of the approximate boundary values is necessary to more reliably locate the beginning and ending boundaries of words.

Referring again to FIG. 2, the system adjusts the approximate boundary values using one of the two methods, depending upon the noise level of the signal. The cutoff noise level evaluated by step 24 may be represented by $E_{ave}=2.0$. Thus, if $E_{ave}$ is greater than 2.0, the system proceeds to step 26. If $E_{ave}$ is less than or equal to 2.0, then the system proceeds to step 28. An $E_{ave}$ of 2.0 roughly corresponds to an SNR of 15 dB.

If, at step 24, the system determines that the noise level of the signal is high or medium, the system proceeds to step 26, to make a single adjustment to the approximate boundary values. The single adjustment value or adjustment factor is subtracted from the approximate beginning word boundary and added to the approximate ending word boundary. The adjustment value is given by the following equation:

$$\text{Adjustment}=B*E_{ave}+C \quad (2)$$

B and C are configurable parameters of the system which are selected to optimize the amount of adjustment. B and C may be derived experimentally by processing known inputs wherein the location and length of words are known prior to processing.

It has been found that the system operates most effectively when parameters B and C take on differing values depending upon the amount of noise present in the speech signal. Also, the value of B and C can be made to depend, in part, on a zero crossing rate which is representative of the rate at which speech signal S(t) passes from being positive to being negative. The zero crossing rate is a function of time, and may be represented by Z(t). An average zero crossing rate $Z_{ave}$ is calculated by averaging Z(t) over the entire signal. Further, B and C preferably take on different values for beginning or ending adjustment values.

Depending upon the specific values for $E_{ave}$ and $Z_{ave}$, the following values for B and C have been found to be effective.

If $E_{ave}$ is greater than 2.4, indicating a high noise level, and $Z_{ave}$ is less than 5.0, then B=3.0 and C=8.0 for a beginning boundary value adjustment, and B=7.0 and C=8.0 for an ending boundary value adjustment. With these parameters, the resulting adjustment value is expressed in the number of time frames, rather than in a time value, such as seconds or milliseconds.

If $E_{ave}$ is greater than 2.4 and $Z_{ave}$ is greater than or equal to 5.0, then B=3.0 and C=0.0 for the beginning boundary value adjustment, and B=7.0 and C=0.0 for the ending boundary value adjustment.

If $E_{ave}$ is greater than 2.0 but less than or equal to 2.4, indicating a medium noise level, then the following three conditions apply:

If $Z_{ave}$ is less than 5.0, then B=7,.5 and C=8.0 for the beginning boundary value adjustment, and B=11.7 and C=8.0 for the ending boundary value adjustment.

If $Z_{ave}$ is greater than or equal to 5.0 but less than 30.0, then B=4.0 and C=0.0 for the beginning boundary value adjustment, and B=6.5 and C=0.0 for the ending boundary value adjustment.

If $Z_{ave}$ is greater than or equal to 30, then B=7.5 and C=0.0 for the beginning boundary value adjustment, and B=11.7 and C=0.0 for the ending boundary value adjustment.

Thus, the system, at step 26, uses the just-described values for B and C to calculate adjustment values. The system then performs a single adjustment to the approximate boundary values by subtracting the beginning boundary value adjustment from the beginning boundary and by adding the ending boundary value adjustment to the ending boundary. In FIG. 6, the resulting final boundary values are indicated in vertical solid lines by reference numerals 74' and 76', respectively. As can be seen from FIG. 6, the final adjusted boundary values define a fairly broad time window in which the word may be reliably be found. The ending word boundary is generally extended a greater amount than the beginning boundary value to compensate for the fact that most words tend to begin sharply, yet end with a diminishing sound.

The time window between the approximate beginning and ending boundaries may be referred to as an island of reliability. In FIG. 5, that portion of signal S(t) occurring before the beginning boundary and after the ending boundary is simply discarded before subsequent processing, as those portions have been reliably determined to be silent portions of the signal. Although not shown in FIG. 5, the input signal may include a group of words, perhaps forming a complete sentence. In such case, the final pair of boundary values will reliably locate the group of words.

Thus, the adjustment values calculated in Equation (2) are applied once to adjust the boundary values of signals having a high or medium noise level.

For signals with a low noise level, a more precise iterative adjustment process, identified by reference numeral 28 in FIG. 2, is implemented. The iterative process is shown schematically in FIG. 7. As can be seen from FIG. 7, the beginning and ending boundaries are processed separately. Iterative adjustment of the beginning boundary value begins with step 80, whereas iterative adjustment of the ending boundary value begins at step 90.

At step 80, a preliminary adjustment value, preferably 20 msec, is subtracted from the beginning boundary value to determine a new approximate beginning boundary value.

At step 82, the logarithm of the RMS energy of the new beginning boundary value is examined to determine whether it exceeds a second, more refined, threshold value $E_{threshold2}$.

$$E_{threshold2}=(E_{max}-E_{ave})/D+E_{ave} \quad (3)$$

The parameter D is a constant value which is a configurable parameter of the system and may be derived experimentally by processing known input signals. It has been found that a value of 3.0 has been effective for use as constant D.

If the logarithm of the RMS energy is found to exceed $E_{threshold2}$ within the time frame containing the new boundary value, then the new approximate boundary value is updated. Comparison of the logarithm of the RMS energy at the time frame of the new boundary value is performed at step 84.

If the logarithm of the RMS energy is found to exceed $E_{threshold2}$ at step 84, then the system returns to step 80 to update the boundary value again.

If, at step 84, the system determines the logarithm of the RMS energy of the new beginning boundary value is below $E_{threshold2}$, then execution proceeds to step 86, where the system performs a second test against $E_{threshold2}$, involving only time frames immediately prior to the new boundary value.

At 86, the system calculates the logarithm of the RMS energy for 10 time frames immediately prior to the new beginning boundary value. If, at step 87, the average of the logarithm of RMS energy within the 10 time frames preceding the new beginning boundary exceeds $E_{threshold2}$, then the system returns to step 80 to adjust the boundary value again. The 10 time frames is also a configurable parameter which may be adjusted to achieve optimal results.

At step 88, the system calculates an average of the zero crossing rate for 10 time frames before the beginning boundary value. If, at step 89, the average of the zero crossing rate for those 10 time frames is greater than a zero crossing rate threshold, then the system again returns to step 80 to further iterate the beginning boundary value. The zero crossing rate threshold is given by 1.3 times the average of the zero crossing rate $Z_{ave}$.

Thus, a total of three tests are performed on the beginning boundary value to determine whether it reliably demarcates a beginning boundary of the word. If any of the three above-described tests fail, the system returns to step 80 to subtract an additional adjustment value from the beginning boundary value to further refine that boundary value. The new adjustment value or "progression step" is set to 20 msec. Iterative adjustment continues until either a boundary value is determined which passes all three tests or an iteration limit is reached. This iteration limit is set to 100 msec for the beginning boundary. Thus, the beginning boundary value will not be advanced more than 100 msec. Hence, the iteration is bounded.

Only when a final boundary value is achieved which passes all three tests or the iteration limit is reached does the system exit the loop of steps 80–89 of FIG. 7 to proceed to the analysis, quantization, and matching phases summarized with reference to FIG. 1.

Simultaneously, while the beginning boundary value is iteratively updated, the system operates to iteratively update the ending boundary value. The operations performed on the ending boundary value are similar to that of the beginning boundary value and will only be summarized.

At step 90, the system sets a new ending boundary value by adding 50 msec to the ending boundary. Next, at step 92, the system determines the logarithm of the RMS at the time frame of the new ending boundary value. At step 94, the system compares the logarithm of the RMS energy to $E_{threshold2}$ and returns to execution step 90 if this value exceeds $E_{threshold2}$. If the logarithm of the RMS energy does not exceed $E_{threshold2}$, the system proceeds to perform two more tests, identified by reference numerals 96–99, involving the logarithm of the RMS energy for 10 time frame and the average zero crossing rate for those 10 time frames. More specifically, the system calculates the logarithm of the RMS energy, at step 96, for the 10 time frames immediately subsequent to the new ending boundary value to determine whether it exceeds $E_{threshold2}$ as given by Equation (3). If, at step 97, this value exceeds $E_{threshold2}$, then execution continues at step 90. If not, the system calculates the average of the zero crossing rate for those 10 time frames. If this value exceeds a zero crossing rate threshold equal to four times the average zero crossing rate for the time frames, then execution also returns to step 90 for further processing. An adjustment value or "progression step" of 50 msec continues to be used for the ending boundary value.

As with the adjustment of the beginning boundary value, the adjustment of the ending boundary value is bounded. Iteration will not proceed beyond 150 msec.

Only after the ending boundary value is adjusted by a sufficient amount to pass all three above-described tests or the iteration limit of 150 msec is reached will the system proceed to the analysis, quantization, and matching phases summarized with reference to FIG. 1. As shown in FIG. 7, iterative processing of the beginning and ending boundary values may occur in parallel. Alternatively, the iteration of the ending boundary value may be performed subsequent to iterative of the beginning boundary value. Other specific parallel or sequential implementations are available, depending upon the hardware of the system.

To briefly summarize, the system processes an input speech signal to determine the boundary values reliably demarcating words within the speech signal. First, the system divides the input signal into a set of time windows and calculates comparison values for each time window, representative, in part, of frequency components of the signal within the time frames, to produce a comparison function which varies with time. Next, the system compares the comparison function with a threshold value to determine approximate boundary values. The approximate boundary values represent the first and last crossover points where the comparison function crosses the threshold value, either by rising from below the threshold to above the threshold, or by dropping from above the threshold to below the threshold. Once the approximate boundary values are calculated, the system adjusts the boundary values to achieve final boundary values. The specific amount of adjustment varies, depending upon the noise level of the signal. If a high or medium noise level exists, then a single adjustment occurs. The single adjustment amount varies according to the specific noise level. If a low noise level exists, then a more refined iterative adjustment is performed. The beginning and ending boundary values. Then, these new values are tested against various threshold values. If any of a number of tests fail, then iteration continues and the beginning and ending boundary values are adjusted by a greater amount. Only after the updated boundary values pass all tests or a boundary limit is reached will the system proceed to analyze the content of the words found between the boundary values.

Those skilled in the art will appreciate that various adaptations and modifications of the just-described preferred embodiment can be configured without departing from the scope and spirit of the invention. Therefore, it is to be understood that, within the scope of the appended claims, the invention may be practices other than as specifically described herein.

What is claimed is:

1. A method for determining boundaries of words carried within a time-varying speech signal, said signal being representative of words separated by regions of relative silence, said method comprising the steps of:

determining a constant threshold value representative of an average of said signal within said regions of relative silence, said threshold value determined by calculating a maximum value, $E_{max}$, and an average value, $E_{ave}$, of the root-mean-square, RMS, energy contained within the signal;

determining a time-varying comparison signal representative of said signal biased to emphasize components of said signal having frequencies within a preselected frequency band, said comparison signal based upon a measurement of linear energy within said signal and a measurement of frequency of said signal;

comparing said time-varying comparison signal with said constant threshold value to determine first and last crossover times when said time varying comparison signal crosses said threshold value, said times representing boundaries of said words for reliably locating the beginning and ending of said words within the speech signal;

determining an average level of noise in said signal; and adjusting said boundaries by applying adjustment values, varying according to the average level of noise and the measurement of linear energy in said signal.

2. The method of claim 1, wherein said step of determining a time-varying comparison signal comprises the steps of:

determining a time-varying signal representative of a logarithm of a root-mean-square (RMS) energy of said speech signal;

determining a time-varying signal representative of components of said signal having frequencies in said preselected frequency band; and adding said time-varying signal representative of the logarithm of the RMS energy within said speech signal to said time-varying signal representative of components of said signal having frequencies within said preselected frequency band.

3. The method of claim 1, wherein said preselected frequency band extends from 250–3500 Hz.

4. The method of claim 1, wherein said step of determining said threshold value comprises the steps of:

determining the maximum value, $E_{max}$, of an RMS energy of the speech signal;

determining an average value, $E_{ave}$, of an RMS energy of said regions of relative silence; and calculating said threshold the value from the equation:

$$E_{threshold}=((E_{max}-E_{ave})*E_{ave}^{3})*A,$$

where A is a preselected constant.

5. The method of claim 4, wherein said constant A is approximately 2.9.

6. The method claim 1, wherein said step of comparing said time-varying comparison signal to said constant threshold value further comprises the steps of:

determining an approximate beginning word boundary time by determining when said time-varying comparison signal first rises from below said threshold value to above said threshold value;

determining an approximate ending word boundary time by determining when said time-varying comparison signal last drops from above said threshold value to below said threshold value;

determining an average level of noise in said speech signal; and adjusting approximate word boundary times by applying an adjustment factor representative of the average level of noise of said signal and a measurement of the linear energy of said signal.

7. The method of claim 6, comprising the additional steps of adjusting the approximate word boundary times by:

determining an average level of noise in the speech signal;

determining first and second adjustment values based on said average level of noise;

adding said first adjustment value to said ending word boundary time; and subtracting said second adjustment value from said beginning word boundary time.

8. The method of claim 6, comprising the additional steps of iteratively adjusting the approximate word boundary times by:

adding a first adjustment value to the ending boundary time to obtain a value for the ending boundary time;

subtracting a second adjustment value from the beginning boundary time to obtain a new value for the beginning boundary time;

comparing values representative of the signal level at the adjusted boundary times to a second threshold value; and repeating said steps of adding a first adjustment value to said ending boundary time and subtracting a second adjustment value to said beginning boundary time if said second threshold value continues to exceed said values representative of the signal level of the adjusted boundary times.

9. The method of claim 8, wherein said first adjustment value is initially 50 msec and said second adjustment value is initially 20 msec.

10. The method of claim 8, wherein said values representative of said signal level are representative of the logarithm of an RMS energy of the signal and representative of a zero crossing rate of the signal.

11. The method of claim 6, comprising the additional steps of:

adjusting the approximate word boundary times by:

determining an average level of noise in the speech signal;

if the average level of noise in the signal exceeds a predetermined noise level, performing the steps of:

adding a first adjustment value to said ending word boundary time; and subtracting a second adjustment value from said beginning word boundary time;

if the average level of noise in the signal does not exceed the predetermined noise level, performing the steps of:

iteratively adjusting the approximate word boundary times by:

adding a third adjustment value to the ending boundary time to obtain a new value for the ending boundary time;

subtracting a fourth adjustment value from the beginning boundary time to obtain a new value for the beginning boundary time;

comparing values representative of said signal at said new boundary times to a second threshold value; and repeating said steps of adding a third adjustment value to said ending boundary time and subtracting a fourth adjustment value to said beginning boundary time if said second threshold exceeds said values representative of said signal of said new boundary times.

12. The method of claim 11, wherein said predetermined noise-level approximately corresponds to a signal-to-noise-ratio of 15 dB.

13. The method of claim 1, wherein said crossover times represent approximate beginning and ending boundary times, and wherein maximum boundary times are derived from said approximate boundary times, with ranges of time between the maximum boundary times and the approximate boundary times representing ranges of time value in which the actual beginning and ending boundaries of words may be reliably found.

14. A method for determining beginning and ending boundaries of words carried within a time-varying speech signal, said signal being representative of a plurality of words separated by regions of relative silence, said method comprising the steps of:

determining a threshold value representative of an average of said signal within regions of relative silence, said threshold value determined by calculating a maximum value, $E_{max}$, and an average value, $E_{ave}$, of the root-mean-square, RMS, energy contained within the signal;

determining a time-varying comparison signal representative of said signal biased to emphasize components of said signal having frequencies within a preselected frequency band, said comparison signal based upon a measurement of linear energy within said signal and a measurement of frequency of said signal;

comparing said time-varying comparison signal to said threshold value to determine times when said signal crosses said threshold value, said times being an indication of approximate boundary times of said words within said signal;

determining an average level of noise in said signal; and adjusting said approximate boundary times by applying adjustment values, said adjustment values varying according to the average level of noise in said signal and a measurement of linear energy in said signal.

15. A method for determining beginning and ending boundaries of words carried within a speech signal comprised of energy values varying with time, said signal being representative of words separated by regions of relative silence, said signal having a zero crossing rate representative of the rate at which the energy values of the signal pass through a zero energy level, said signal including an initial period of relative silence, said method comprising the steps of:

dividing said speech signal into a plurality of time windows, each time window having a plurality of sequential energy values;

determining a discrete threshold value representative of an average energy for energy values occurring in said initial period of relative silence;

for each time window, determining a parameter representative of a sum of said energy values of said signal within the window biased to emphasize components of the signal having frequencies within a preselected frequency band to plurality of said parameters varying as a function of time;

comparing said comparison function with said threshold value to determine time values when said comparison function crosses said threshold value, said time values being an indication of the boundaries of words within said signal;

determining an average level of noise in said signal; and adjusting said time values by applying an adjustment factor representative of the average level of noise of said signal and a measurement of the linear energy in said signal.

* * * * *